US009243446B2

(12) United States Patent
Weiss

(10) Patent No.: US 9,243,446 B2
(45) Date of Patent: Jan. 26, 2016

(54) GAPLESS ROLLER BLIND DEVICE FOR THE ACCESS OPENING OF A REFRIGERATION UNIT

(76) Inventor: Albert Weiss, Osterburken (DE)

( * ) Notice: Subject to any disclaimer, the term of this patent is extended or adjusted under 35 U.S.C. 154(b) by 136 days.

(21) Appl. No.: 13/984,885

(22) PCT Filed: Feb. 10, 2012

(86) PCT No.: PCT/EP2012/052255
§ 371 (c)(1),
(2), (4) Date: Oct. 28, 2013

(87) PCT Pub. No.: WO2012/107540
PCT Pub. Date: Aug. 16, 2012

(65) Prior Publication Data

US 2014/0034250 A1 Feb. 6, 2014

(30) Foreign Application Priority Data

Feb. 10, 2011 (DE) ..... 10 2011 010 967

(51) Int. Cl.
*E06B 9/08* (2006.01)
*E06B 9/42* (2006.01)
(Continued)

(52) U.S. Cl.
CPC ... *E06B 9/42* (2013.01); *E06B 9/24* (2013.01); *A47F 3/0469* (2013.01); *E06B 2009/2441* (2013.01); *E06B 2009/2447* (2013.01); *E06B 2009/2458* (2013.01)

(58) Field of Classification Search
CPC ..... E06B 9/40; E06B 2009/2441; E06B 2009/2447; E06B 2009/2458
USPC ..... 160/84.01, 108, 121.1
See application file for complete search history.

(56) References Cited

U.S. PATENT DOCUMENTS 2,865,446 A * 12/1958 Cole ..... 160/85
2,970,643 A 2/1961 Adamsky
(Continued)

FOREIGN PATENT DOCUMENTS

DE 93 07 028.4 9/1993
DE 44 26 231 A1 1/1996
(Continued)

OTHER PUBLICATIONS

German Patent Office Search Report, Jul. 30, 2011.
(Continued)

*Primary Examiner* — Blair M Johnson
(74) *Attorney, Agent, or Firm* — Dority & Manning, P.A.

(57) ABSTRACT

The invention relates to a roller-screen arrangement having covering roller screens which are arranged axially one beside the other and can be jointly rolled up onto, and unrolled from, a winding roller, wherein the free ends of the covering roller screens are oriented in opposite directions. The covering roller screens can thus be jointly rolled up onto, and unrolled from, the winding roller, wherein furthermore, in the unrolled state, a distance A is formed between the covering roller screens. A cavity is created between the covering roller screens, and at least one intermediate roller screen is provided in this cavity in order to cover gaps between the covering roller stir screens arranged axially one beside the other. When the covering roller screens are opened and closed, the intermediate roller screens are taken up and let down and picked up again in accordance with the shortening and lengthening of the covering roller screens.

17 Claims, 3 Drawing Sheets

(51) Int. Cl.
*E06B 9/24* (2006.01)
*A47F 3/04* (2006.01)

(56) References Cited

U.S. PATENT DOCUMENTS

| | | | | |
|---|---|---|---|---|
| 4,408,650 | A * | 10/1983 | Verch | 160/121.1 |
| 5,419,385 | A | 5/1995 | Vogel et al. | |
| 7,128,121 | B2 * | 10/2006 | Nien | 160/121.1 |
| 8,261,807 | B2 * | 9/2012 | Dann et al. | 160/84.01 |
| 2005/0178509 | A1 * | 8/2005 | Byeon | 160/121.1 |
| 2009/0250177 | A1 * | 10/2009 | Byeon | 160/323.1 |
| 2012/0125546 | A1 | 5/2012 | Cooper et al. | |
| 2012/0222824 | A1 * | 9/2012 | Lin | 160/25 |
| 2014/0034250 | A1 * | 2/2014 | Weiss | 160/108 |

FOREIGN PATENT DOCUMENTS

| | | | |
|---|---|---|---|
| DE | 297 09 524 | | 12/1998 |
| DE | 100 21 656 | A1 | 11/2001 |
| DE | 201 01 977 | U1 | 7/2002 |
| WO | WO 2011/064318 | A2 | 6/2011 |

OTHER PUBLICATIONS

International Preliminary Report on Patentability, Aug. 22, 2013.

* cited by examiner

-Prior Art-

GAPLESS ROLLER BLIND DEVICE FOR THE ACCESS OPENING OF A REFRIGERATION UNIT

FIELD OF THE INVENTION

The present invention refers to a roller blind device with roll covers axially arranged side by side in an abutting configuration that can be jointly rolled up and unrolled on a winding roll.

BACKGROUND

Gaps are formed between the individual roll covers of conventional systems, allowing the passage of ambient air into the refrigeration unit, thus drastically lowering the energy performance of its refrigerating capacity. For this reason, according to an earlier application (Ref: PCT/EP2010/068261, corresponding to WO 2011/064318) of the same applicant, the intention was to cover the gap formed between the roll covers by using so-called intermediate roller blinds that can also be rolled up and unrolled when the roll covers are rolled up and unrolled so the resulting gap between the roll covers can be covered in the lowered position. These intermediate roller blinds and their rolling-up mechanism require a drive, so that when they are rolled up and unrolled they can always cover the gap well and at the same time ensure uniform unrolling so the fabric webs of the intermediate roller blind and the roll cover lie uniformly next to one another and thus seal well.

As mentioned in the earlier patent application, a similar device is known from DE 201 01 977 U1 that also overlaps the edges of the roll covers and can be rolled up and unrolled with them through a separate drive and a transmission gear. Since the drive of the intermediate roller blind must be synchronous with the roll covers, a suitable control of this drive is required. This driver, however, is complex and expensive, particularly because the roller blind device must be assembled on site, as the intermediate roller blind needs to engage in the roll covers so it can cover the gap by overlapping the edges. Although the earlier application resolved this deficiency, it was also relatively complex and expensive. It was also found that the proper rolling-up and unrolling of the intermediate roller blind was not always guaranteed.

SUMMARY

A task of this invention is to improve the earlier roller blind device by a simplifying the drive that moves the intermediate roller blind and making it less expensive. Objects and advantages of the invention are set forth in part in the following description, or may be obvious from the description, or may be learned through practice of the invention.

FIG. 5 corresponds to FIG. 7 from WO 2011/064318 and illustrates the prior art configuration of multiple, axially arranged roller blind assemblies discussed above. In articular a plurality of the roller blind assemblies are axially arranged along a segmented winding roll 10, with each assembly having a first roll cover 1 attached to a rod 2 at a lower end. An axial gap 13 is defined between the adjacent roll covers 1. Intermediate roller blinds 7 have an upper end suspended by a rail 72 and a lower end attached to a take up roller 71. The intermediate roller blinds 7 bridge across the gaps 13 between the first roll covers 1. Second roll covers (not visible in FIG. 5) are also attached to the winding roll segments 10 and rod 2 with an axial gap 13 between adjacent ones of the second roll covers. The first roll covers 1 and second roll covers define a hollow space in which the roller blinds 7 are located. As discussed above, this prior art configuration requires a roll-up mechanism 71 and associated drive.

Referring to FIG. 1, the intermediate roller blind 7 is no longer rolled up, but the web of the intermediate roller blind 7 that becomes free when pulling up the roll cover 1; 11 is collected and stacked. This eliminates the entire winding mechanism and drive that needed to be synchronized with the rolling up and unrolling of the roll cover 1; 11. The roller blind rod 2 is designed as a collecting tray. The roll covers 1 and 11 attached to the roller blind rod 2 serve to enlarge the collecting tray formed by the roller blind rod 2 and prevent the collected intermediate roller blinds 7 from falling out. As a result of this, the roller blind device becomes lighter, considerably less complex, and also needs less space. The intermediate roller blind 7 adjusts automatically to the web of the roll cover 1; 11 with the up and down movement of the roll cover. Additional drive elements and synchronous controls are not needed.

The intermediate roller blind 7 is advantageously made of lightweight, flexible fabric such as a kind of lining or foil with the corresponding properties, for example, so the intermediate roller blind 7 can be easily folded. To compensate for web tolerances, the intermediate roller blind 7 has preferably an elastic strip at the upper end through which the intermediate roller blind 7 is fastened to a rail 72 that preferably has a sliding groove 74 to position the intermediate roller blind 7 as desired. To prevent airflow and therefore cooling energy losses between the interior of the refrigeration unit and its surroundings, a sealing lip 4 has been provided on the roller blind rod 2 that seals off the refrigerating unit from the ambient air of the sales area when the access opening to the refrigeration unit is closed. Basically, the structure of the roller blind device according to the invention is the same as in the earlier application (PCT/EP2010/068261) of the same applicant.

BRIEF DESCRIPTION OF THE DRAWINGS

Further details of the invention will be described with reference to the drawings, which show.

DETAILED DESCRIPTION

Figure 3:
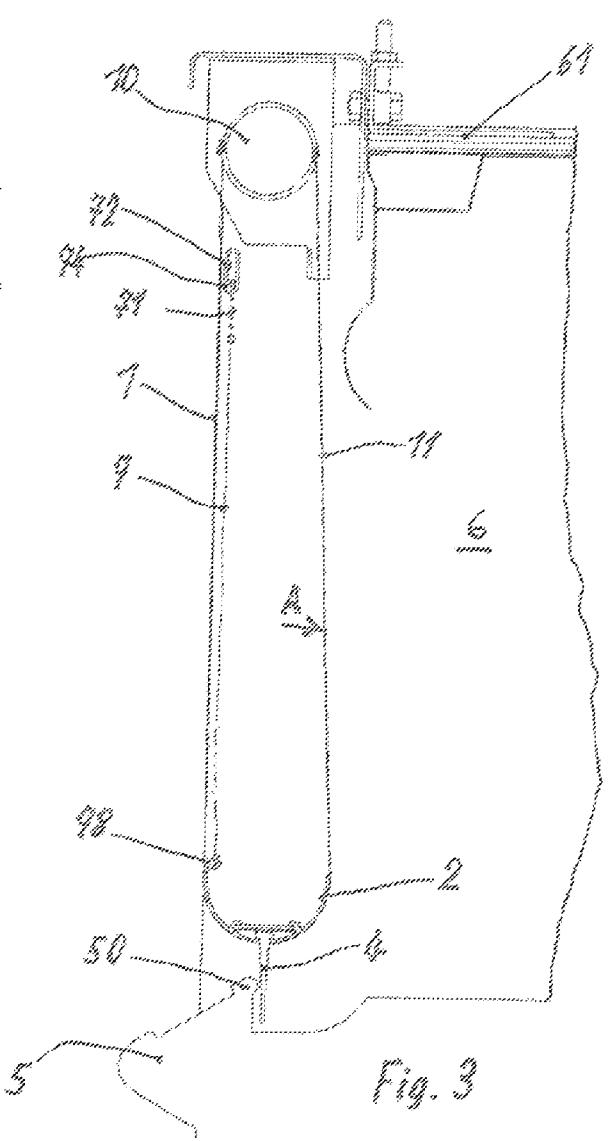
FIG. 3: the roller blind device according to the invention in closed position.

Reference is now made to particular embodiments of the invention, one or more examples of which are illustrated in the drawings. Each embodiment is provided by way of explanation of the invention, and not as a limitation of the invention. For example, features illustrated as described as part of one embodiment may be used with another embodiment to yield still a further embodiment. It is intended that the present invention include these and other modifications and variations.

Figure 1:
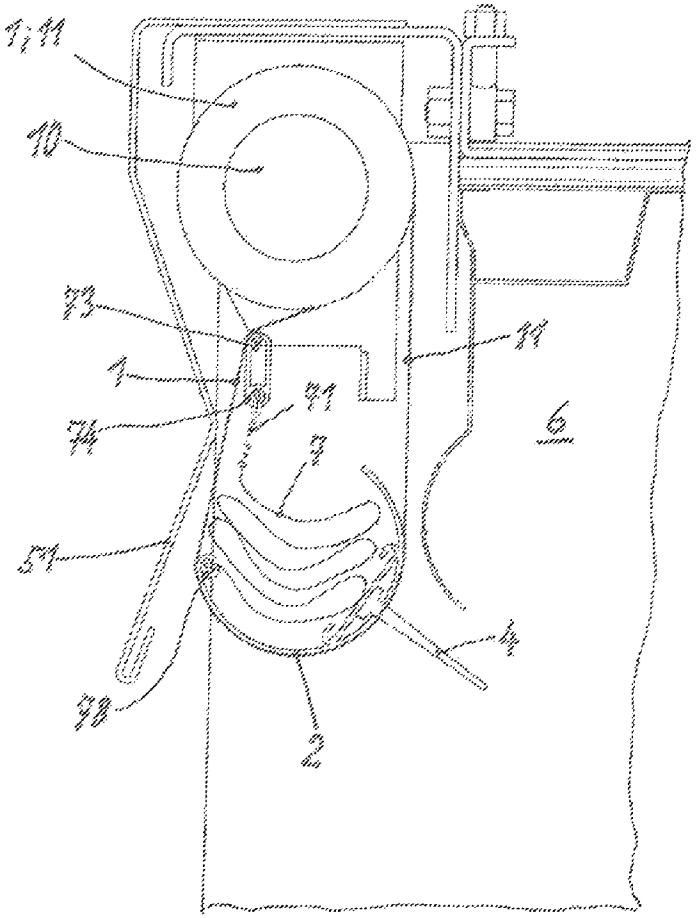
FIG. 1: the roller blind device according to the invention in a raised position.

The roller blind according to the invention is used to cover the access opening of a refrigeration unit to reduce cold air loss outside of business hours and thus to keep energy consumption as low as possible. For that coverage, such roller blind devices use, among other things, 2 roller blind webs, which enclose an intermediate space between them that also serves insulation purposes when the access opening is closed. When the roller blind is pulled up, the two roll covers 1 and 11 are raised together and rolled up on a winding roll 10. The cutout in FIG. 1 shows the refrigeration unit in the open position. The outward facing roll cover 1 and the roll cover 11 facing the interior of the refrigeration unit have been pulled up and rolled up onto the winding roll 10. When unrolled (see FIG. 3), both roll covers 1 and 11 are fastened at a distance onto the periphery of the winding roll 10, but the ends point in opposite directions. Both roll covers 1 and 11 are equally long, so when they are unrolled, the access opening on the refrigeration unit 1 is closed with two roll covers 1 and 11.

An air space that also acts as insulator is enclosed between the two roll covers 1 and 11. According to the diameter of the winding roll 10, space A (shown in FIG. 3) is formed between the two roll covers 1 and 11. When they are rolled up (FIG. 1), both roll covers 1 and 11 lie on top of one another and create a corresponding double-layered roll-up on the winding roll 10.

A roller blind rod 2 (which is shaped as a basket-like collection device for receiving the released fabric web of the intermediate roller blind 7 when the roll covers 1 and 11 are opened) has been fastened to the free ends of roll covers 1 and 11. In the previous application of the same inventor and patent holder, a winding roll 10 was arranged on the roller blind rod 2 for the intermediate roller blind 7 in order to roll up the resulting length of the intermediate roller blind 7. In the older application, a significant effort was needed for the synchronous obligatory roll-up of the intermediate roller blind 7 that corresponds to the shortening of the roll covers. According to this invention, the intermediate roller blind 7 is not rolled up, but is simply collected in the basket-shaped roller blind rod 2 and stored rolled up. Surprisingly, it has been found that the web of the intermediate roller blind 7 that becomes free folds up by itself when the roll cover 1 or 11 is pulled up due to the shape of the collecting device 2 and the folding properties of the material used for the intermediate roller blind 7. Merely a corresponding limitation of the collecting tray must be provided so the web of the intermediate roller blind 7 that becomes free can be stored securely and completely in the roller blind rod 2.

A rail 72 with a sliding groove 74, into which the intermediate roller blind 7 can be mounted and moved along this sliding groove 74, has been arranged underneath the winding roll 10. As a result of this, it is possible to position the intermediate roller blind 7 in such a way that it can cover the gap between the impact on the roll covers 1 and 11 arranged adjacently to one another. This gap is necessary because the roll cover 1 and 11 too cannot extend continuously over the winding roll 10, but must leave a free space so this winding roll 10 can be stored. The intermediate roller blind 7 is necessary for closing the resulting gap. While the intermediate roller blind 7 is mounted on the sliding groove 74 of the rail 72, the rail 72 is suspended above this sliding groove 74 so there is no interruption of the sliding groove 74. In this way, the intermediate roller blind 7 is guided and fastened continuously and uninterruptedly. As a result of that, no spaces or gaps are formed in the intermediate roller blind 7 that must be covered. The intermediate roller blind 7 can be suspended as a solid, continuous web. Two webs can bump into one other and even in an overlapping way. This demonstrates the enormous advantage of the present invention.

Figure 2:
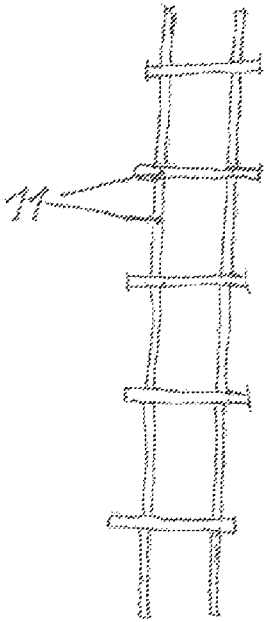
FIG. 2: the structure of the fabric of the inner roll cover.

The suspension of the rail 72 is advantageously carried out in the manner shown in FIG. 3, so that the intermediate roller blind 7 extends as close as possible to the outer roll cover 1. In the interior of the refrigeration unit, temperature differences cause a certain excess pressure, which exerts an outward pressure and thus would generate air circulation and air exchange in the surrounding space of the refrigerating unit. However, this means cooling and therefore energy loss too. It is the task of the intermediate roller blind 7 to prevent this. Owing to its material that can be easily folded, the intermediate roller blind 7 is supported by the outer roll cover 1. Since the inner roll cover 11 has no supporting function and should not have one, it can therefore be made of less expensive and lighter scrim (FIG. 2). However, it has the task of guiding the intermediate roller blind 7 safely into the tray of the roller blind rod 2 to prevent it from falling out of it.

So it can be displaced, the intermediate roller blind 7 is arranged with its lower end inside the roller blind rod 2 in a mounting groove 78, as shown in FIG. 3. The other end is moveably supported in a rail 72, which is stationary fastened to the refrigeration unit below the winding roll 10 by means of a mounting rail 73. Thus, the intermediate roller blind 7 adjusts itself accordingly and automatically to the extended web of the roll covers 11 or 11. It receives the necessary impulse for doing this by the movement of the roll covers without needing an additional control or drive device.

Since the fabric webs for the individual roller blinds cannot be manufactured without tolerances, an elastic strip 71 has been attached to the upper end of the intermediate roller blind 7, through which the intermediate roller blind 7 is mounted on the sliding groove 74 of the rail 72. This elastic strip 71 compensates for any differences in web length, so that the intermediate roller blind 7 is taut owing to this pull. In its lower part, the frame 5 of the access opening of the refrigeration unit has a sealing stop 50 on which a sealing lip 4 is provided in the lowered position of the roll cover 1, 11, and this lip is pressed against the seal stop 50 by the rotating movement of the roller blind rod 2. When the roll cover 1, 11 is pulled up, the roller blind rod 2 is rotated again in the opposite direction, so that the sealing lip 4 is pivoted away from the seal stop 50 in an approximately horizontal position (FIG. 1).

Figure 4:
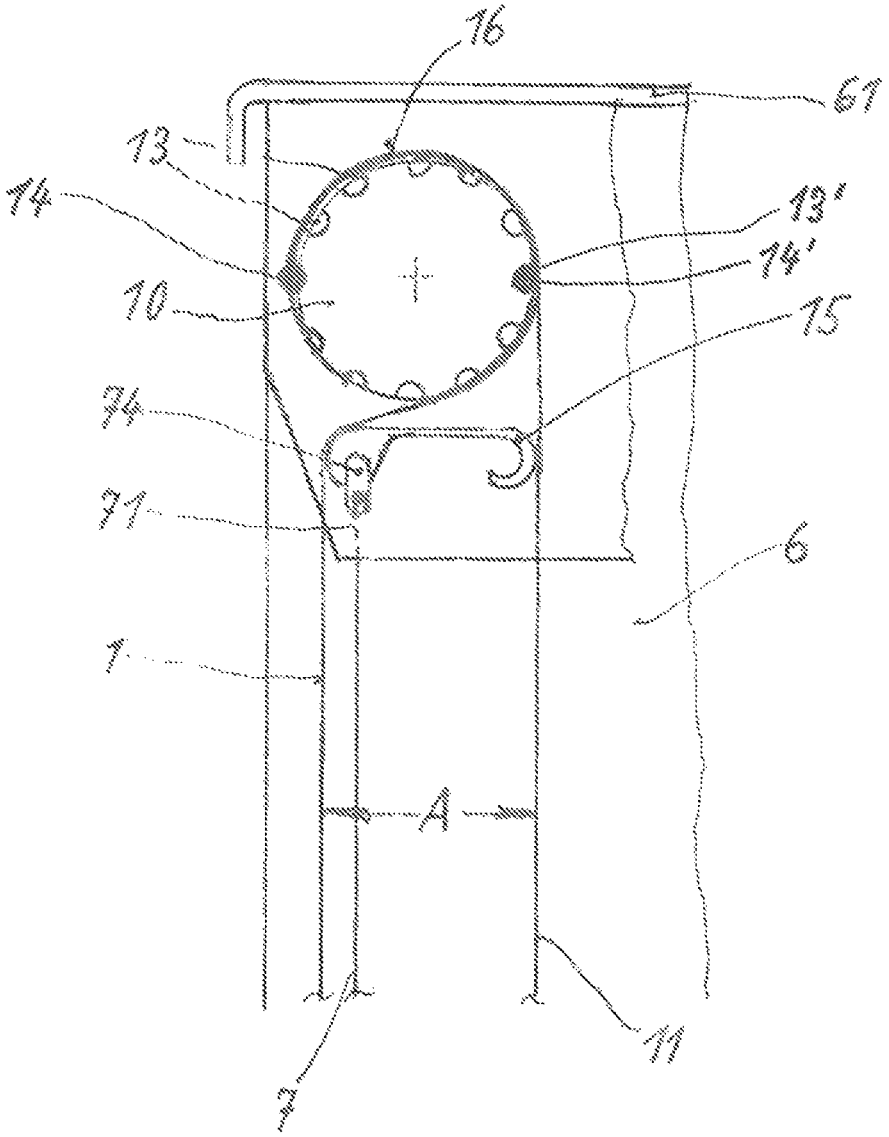
FIG. 4: another embodiment with folded intermediate roller blind and adjustable roller blind web.
Figure 5:
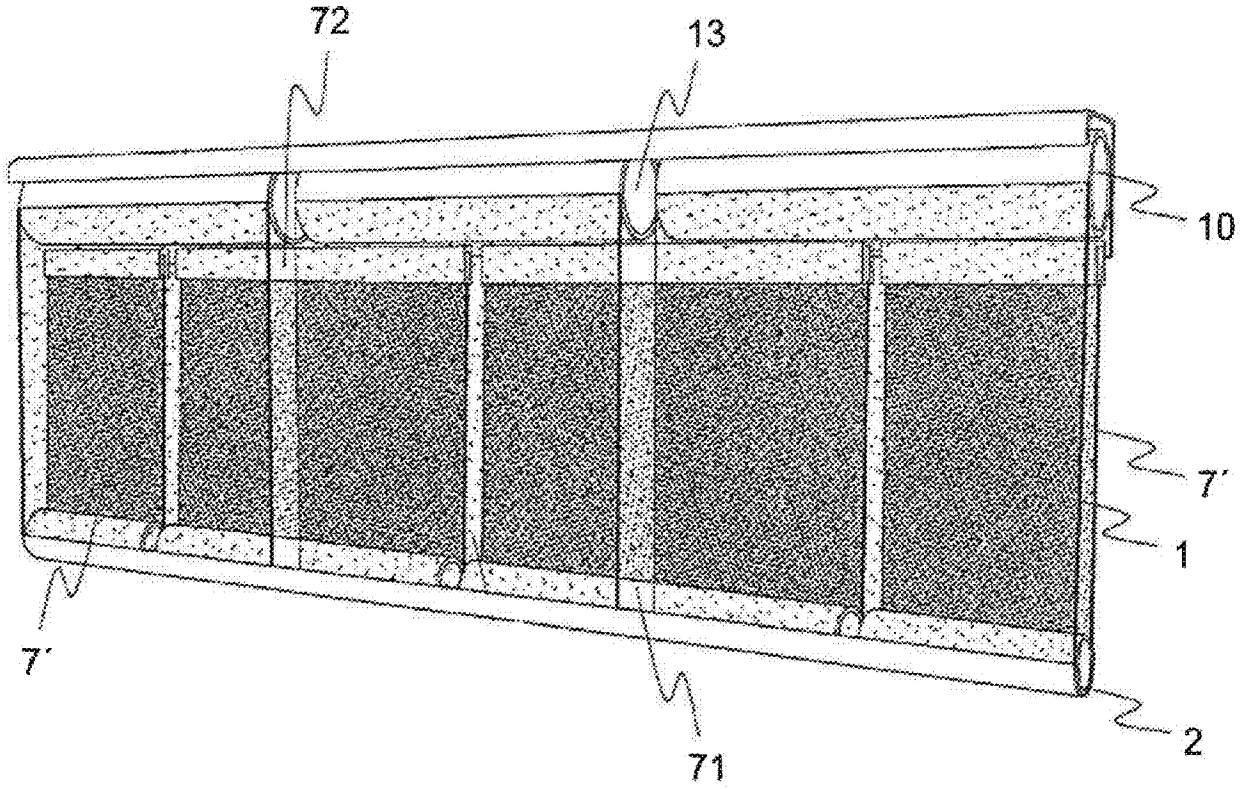
FIG. 5: a prior art depiction tnultiple, axially aligned roller blind assemblies corresponding to FIG. 7 of WO 2011/064318.

FIG. 4 shows a further embodiment of the invention, in which each one of the roll covers 1 and 11 can be adjusted to the desired length if the roller blind's suspension has been lowered by loading the refrigeration unit. Grooves 13 are provided on the periphery of the winding roll 10 into which the end of the roll cover 1 is fixed in place with a weather strip 14. At a certain distance to it, on the periphery of the winding roll 10, the end of the roll cover 11 is fixed in place in the same way with a weather strip 14' in another fastening groove 13'. Owing to the resulting lower final position of the winding roll 10 (as can be inferred from FIG. 4), there is reserve winding 16 available on the winding roll 10 that can be used for compensating web length differences. In this case, the sealing stop 50 is arranged in such a way that the roller blind rod 2 seals against it vertically downwards without any pivotal movement.

To keep the roll covers 1 and 11 over their entire web length independently from the opening of the roll covers in their spacing position, a spreader 15 has been arranged under the winding roll 10 over which the roll covers 1 and 11 slide regardless of the position of the roll covers 1 and 11. The rail suspension 73 has been integrated into this spreader 15 with the rail 72 and the sliding groove 74 into which the intermediate roller blind 7 is mounted.

Modifications and variations can be made to the embodiments illustrated or described herein without departing from the scope and spirit of the invention as set forth in the appended claims.

The invention claimed is:

1. A roller blind device for a refrigeration unit, comprising:

a winding roll;

first roll covers arranged axially adjacent on the winding roll with respective ends attached to a periphery of the winding roll and spaced apart on the winding roller such that axial gaps are defined between adjacent first roll covers;

second roll covers arranged axially adjacent on the winding roll with respective ends attached to a periphery of the winding roll and spaced apart on the winding roller such that axial gaps are defined between adjacent second roll covers;

wherein the first and second roll covers can be rolled up together on the winding roll and unrolled together from the winding roll;

the respective ends of the first and second roll covers spaced apart on the circumference of the winding roll such that, in the unrolled position of the first and second roll covers, a hollow space is defined between the first and second roll covers;

an intermediate roller blind configured within the hollow space to extend across the axial gaps between adjacent first roll covers and adjacent second roll covers; and wherein the intermediate roller blind has an end fixed adjacent to the winding roll and is raised and collected in a folded state as the first and second roll covers are rolled up to a raised position, and unfolded and lowered as the first and second roll covers are unrolled to a lowered position.

2. The roller blind device as in claim 1, further comprising a collecting device configured with the first and second roll covers, the intermediate roller blind folding into the collecting device as the first and second roll covers are rolled up.

3. The roller blind device as in claim 2, wherein the collecting device comprises a tray configured between free ends of the first and second roll covers across the hollow space, the intermediate roller blind folding into the tray-like member.

4. The roller blind device as in claim 3, further comprising a sealing lip configured on an underside of the tray that seals against a stop in a lowered position of the first and second roll covers and intermediate roller blind.

5. The roller blind device as in claim 4, wherein the sealing lip is positioned vertically downwards in a lowered position of the first and second roll covers, and is positioned horizontally in a raised position of the first and second roll covers.

6. The roller blind device as in claim 1, wherein the intermediate roller blind has a length corresponding to an unrolled length of the first and second roll covers.

7. The roller blind device as in claim 6, wherein the intermediate roller blind is formed from a light and flexible fabric.

8. The roller blind device as in claim 7, wherein the intermediate roller blind is formed from a foil material.

9. The roller blind device as in claim 6, wherein the intermediate roller blind comprises an elastic strip at the end fixed adjacent to the winding roll.

10. The roller blind device as in claim 6, wherein the end fixed adjacent to the winding roll is mounted to a rail disposed below the winding roll.

11. The roller blind device as in claim 10, wherein the intermediate roller blind comprises an elastic strip at the end mounted to the rail.

12. The roller blind device as in claim 10, wherein the end of the intermediate roller blind is movably positionable within a sliding groove defined in the rail.

13. The roller blind device as in claim 1, wherein the intermediate roller blind is closer to the first roll cover in the lowered position of the first and second roll covers, the first roll cover being the forward-most of the first and second roll covers.

14. The roller blind device as in claim 13, wherein the first roll cover is formed from a denser fabric than the second roll cover.

15. The roller blind device as in claim 14, wherein the second roll cover is formed from a lattice or netlike fabric.

16. The roller blind device as in claim 1, further comprising a spreader configured below the winding roll to maintain the hollow space between the first and second roll covers.

17. The roller blind device as in claim 1, wherein the first and second roll covers comprise a reserve length of material on the winding roll that provides length adjustability to the first and second roll covers.

* * * * *